US008683842B1

(12) United States Patent
Newell

(10) Patent No.: US 8,683,842 B1
(45) Date of Patent: Apr. 1, 2014

(54) RAILROAD SPIKES AND METHODS OF MAKING THE SAME

(75) Inventor: Hayden W. Newell, Boones Mills, VA (US)

(73) Assignee: Norfolk Southern Corporation, Norfolk, VA (US)

( * ) Notice: Subject to any disclaimer, the term of this patent is extended or adjusted under 35 U.S.C. 154(b) by 265 days.

(21) Appl. No.: 13/069,883

(22) Filed: Mar. 23, 2011

Related U.S. Application Data

(60) Provisional application No. 61/317,054, filed on Mar. 24, 2010.

(51) Int. Cl.
*B21C 23/22* (2006.01)

(52) U.S. Cl.
USPC ..... 72/352; 470/38; 470/39; 72/253.1

(58) Field of Classification Search
USPC ..... 72/253.1, 352; 470/38, 39, 131, 132, 470/137; 238/366
See application file for complete search history.

(56) References Cited

U.S. PATENT DOCUMENTS

| | | | | |
|---|---|---|---|---|
| 308,251 | A | | 11/1884 | Greer |
| 308,252 | A | | 11/1884 | Greer |
| 386,406 | A | | 7/1888 | Jones |
| 1,897,159 | A | | 11/1922 | Williams |
| 3,367,576 | A | * | 2/1968 | Suermann ..... 238/366 |
| 4,022,640 | A | | 5/1977 | Tanczyn |
| 4,129,461 | A | * | 12/1978 | Rashid ..... 148/624 |
| 4,281,429 | A | | 8/1981 | Van den Sype |
| 4,404,830 | A | | 9/1983 | Koch |
| 4,682,381 | A | * | 7/1987 | Jordan et al. ..... 470/39 |
| 4,748,708 | A | | 6/1988 | Schlicht |
| 5,312,214 | A | * | 5/1994 | Morton ..... 411/17 |
| 5,330,594 | A | | 7/1994 | Gallagher, Jr. |
| 5,464,153 | A | * | 11/1995 | Broughton ..... 238/117 |
| 5,826,791 | A | * | 10/1998 | Broughton ..... 238/35 |
| 7,097,403 | B1 | | 8/2006 | Seace |
| 7,347,075 | B2 | | 3/2008 | Vescovini |
| 2004/0016363 | A1 | * | 1/2004 | Phelps et al. ..... 106/1.17 |
| 2008/0116150 | A1 | * | 5/2008 | Lloyd ..... 210/764 |

* cited by examiner

*Primary Examiner* — Shelley Self
*Assistant Examiner* — Pradeep C Battula
(74) *Attorney, Agent, or Firm* — Goodwin Procter LLP

(57) ABSTRACT

Embodiments of the present invention are directed to improved designs of railroad spikes and improved methods of manufacturing the same. According to one exemplary embodiment, a method for manufacturing a railroad spike may comprise the steps of: preparing a metal blank having a substantially circular cross-section; subjecting the metal blank to at least one cold heading process and at least one cold extrusion process to form a railroad spike having (a) a circular head with a fillet at its bottom side that is angled to engage a railroad tie plate or rail base and (b) a non-threaded shank with a substantially square cross-section and a chiseled tip; and coating the railroad spike with an anti-corrosion material.

10 Claims, 7 Drawing Sheets

From http://farm1.static.flickr.com/1/123467820_08b3fc29a8.jpg

From http://www.washoe.k12.nv.us/americanhistory/elementary/si_07_jpegs/Steenberg_railroad_spike.jpg From http://www.allenrailroad.com/consulting/Railroad_Glossary.htm
(retrieved March 21, 2011)

RAILROAD SPIKES AND METHODS OF MAKING THE SAME

CROSS-REFERENCE TO RELATED APPLICATION(S)

The present application claims priority to U.S. Provisional Patent Application No. 61/317,054, filed Mar. 24, 2010 and having the same tile, which is incorporated herein in its entirety.

FIELD OF THE INVENTION

The present invention relates generally to railroad technologies. More particularly, the present invention relates to improved railroad spikes and methods of making the same.

BACKGROUND OF THE INVENTION

A small yet critical component of railroads is a railroad spike. It is a relatively simple metal fastener numerous of which are used to secure the thousands of miles of railroad tracks to wooden crossties. FIG. 1A shows well known railroad spikes, which typically have a crude, asymmetrical shape. FIG. 1B shows how railroad spikes help fasten tracks (rail bases) to crossties, sometimes via tie plates. The prior art railroad spikes shown here are of the strike-in type as opposed to the threaded type that is screwed through a tie plate to fasten to a crosstie. The present invention is primarily concerned with the strike-in type of railroad spikes.

Once it is hammered through a tie plate and into a crosstie, a railroad spike will be subject to cyclic stresses as trains pass by and apply loads on the track rails, causing fatigue to its metal material. The spike will reach its fatigue life and break sooner or later. Apart from cyclic stresses, fungi and insects, known as "spike kill," can erode railroad spikes, thereby further shortening their useful life. As a result, railroad spikes have to be removed and replaced from time to time, which process costs railway companies a significant amount of time and resources.

Railroad spikes typically have been manufactured in hot forging processes which involve heating up raw metal parts above their recrystallization temperature before deforming them into desired shapes. However, hot forged spikes have shown an unsatisfactorily short fatigue life, usually failing approximately one to two inches from the bottom of the head. Current hot forging processes for manufacturing spikes are inefficient in a number of aspects, such as manual placement of discrete metal blanks into a forming die, the need to significantly heat up the raw material, the need to cool down the spikes after forging, and the use of bulky and heavy metal containers for the spikes.

Furthermore, the current asymmetrical designs of strike-in railroad spikes make it inefficient or difficult to load them into automatic spiker machines.

Previous railroad spikes also lack adequate surface treatment (e.g., protective coating). As a result, they suffer from corrosion and/or cause deterioration to crossties.

In view of the foregoing, it may be understood that there are significant problems and shortcomings associated with current designs and manufacturing methods of railroad spikes. As railway companies consume large quantities of railroad spikes, even a small incremental improvement in spike design and/or spike manufacturing process could translate into tremendous savings in terms of time, materials, and other resources.

SUMMARY OF THE INVENTION

Embodiments of the present invention are directed to improved designs of railroad spikes and improved methods of manufacturing the same.

According to one exemplary embodiment, a method for manufacturing a railroad spike may comprise the steps of: preparing a metal blank having a substantially circular cross-section; subjecting the metal blank to at least one cold heading process and at least one cold extrusion process to form a railroad spike having (a) a circular head with a fillet at its bottom side that is angled to engage a railroad tie plate or rail base and (b) a non-threaded shank with a substantially square cross-section and a chiseled tip; and coating the railroad spike with an anti-corrosion material.

According to another exemplary embodiment, an improved railroad spike may comprise: a circular head formed in a cold heading process, the head having a fillet at its bottom side that is angled to engage a railroad tie plate or rail base; and a non-threaded shank formed in a cold extrusion process from a round stock, the shank having a substantially square cross-section and a chiseled tip, and the shank being further coated with an anti-corrosion material.

BRIEF DESCRIPTION OF THE DRAWINGS

In order to facilitate a fuller understanding of the present invention, reference is now made to the accompanying drawings, in which like elements are referenced with like numerals. These drawings should not be construed as limiting the present invention, but are intended to be exemplary only.

The present invention will now be described with reference to exemplary embodiments thereof as shown in the accompanying drawings. While the description below makes reference to exemplary embodiments, it should be understood that the present invention is not limited thereto. Those of ordinary skill in the art having access to the teachings herein will recognize additional implementations, modifications, and embodiments, as well as other fields of use, which are within the scope of the present invention as described herein, and with respect to which the present invention may be of significant utility.

DESCRIPTION OF THE INVENTION

Embodiments of the present invention provide for improved designs and manufacturing processes for railroad spikes. Instead of starting from discrete metal blanks, a round stock of raw metal (e.g., high-strength, low-alloy steel) can be continuously fed into one or more spike-making machines. The spikes are shaped during a cold forming process, in which the metal is worked on all sides. The resulting spikes not only enjoy improved steel strength and fatigue resistance as compared to hot-forged spikes but also have a substantially symmetric shape which facilitates efficient loading into automatic spiker machines. Finished spikes are further coated with disodium octaborate tetrahydrate (DOT) and/or other chemical(s) to protect against spike kill such as fungi and insects.

Other features and advantages of the present invention may be appreciated from the following illustration and description.

Figure 1A:
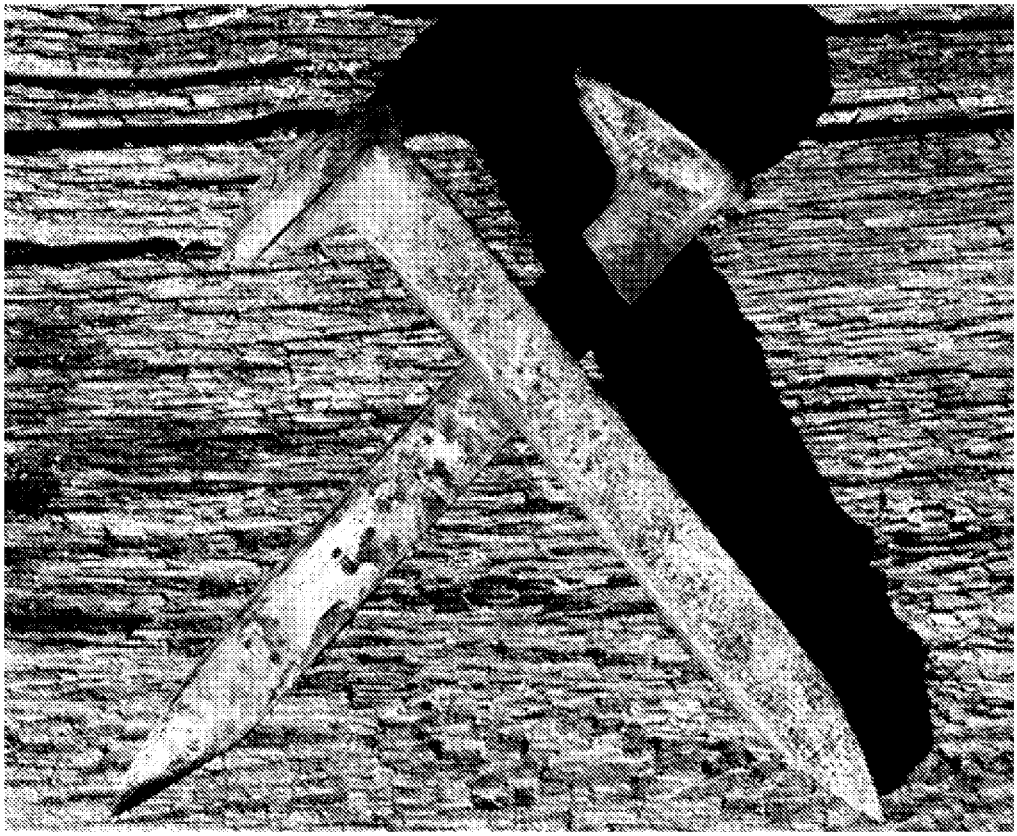
Figure 1A (Prior Art)
FIG. 1A shows some well known railroad spikes.
Figure 1A:
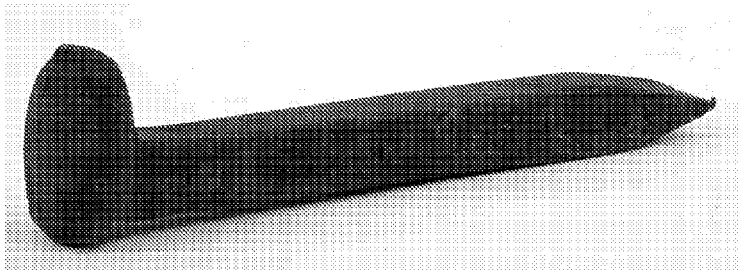
Figure 1A (Prior Art)
Figure 1B:
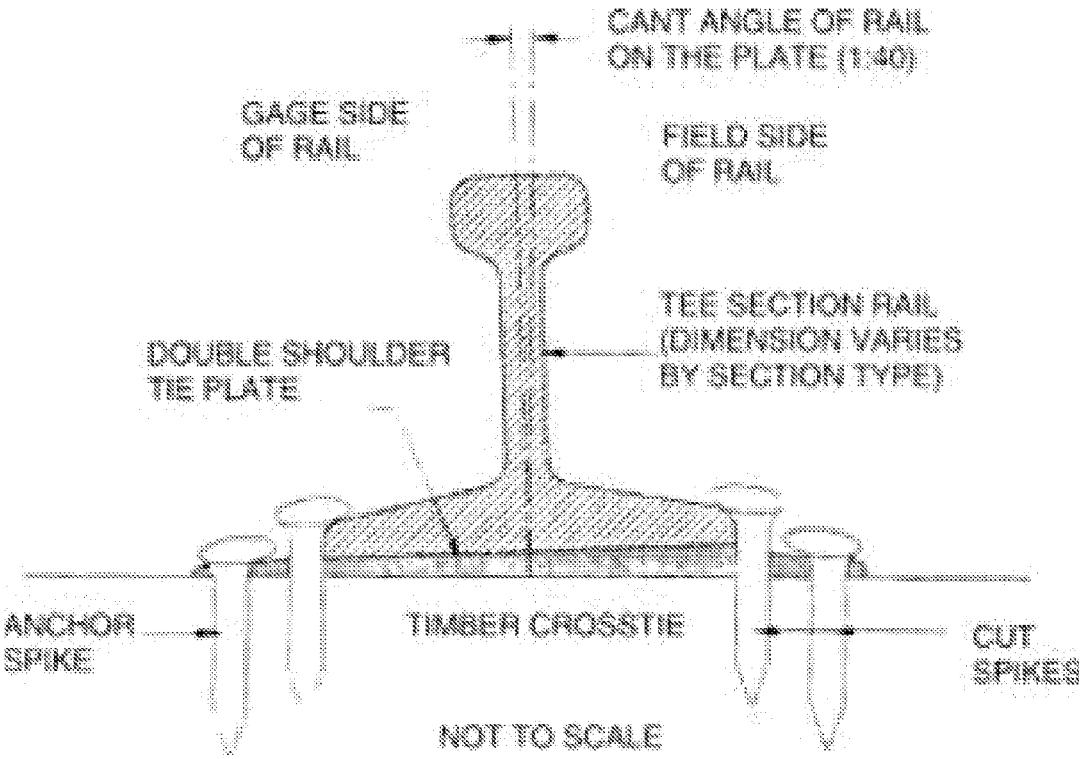
Figure 1B (Prior Art)
FIG. 1B shows how railroad spikes help fasten tracks to crossties.
Figure 2:
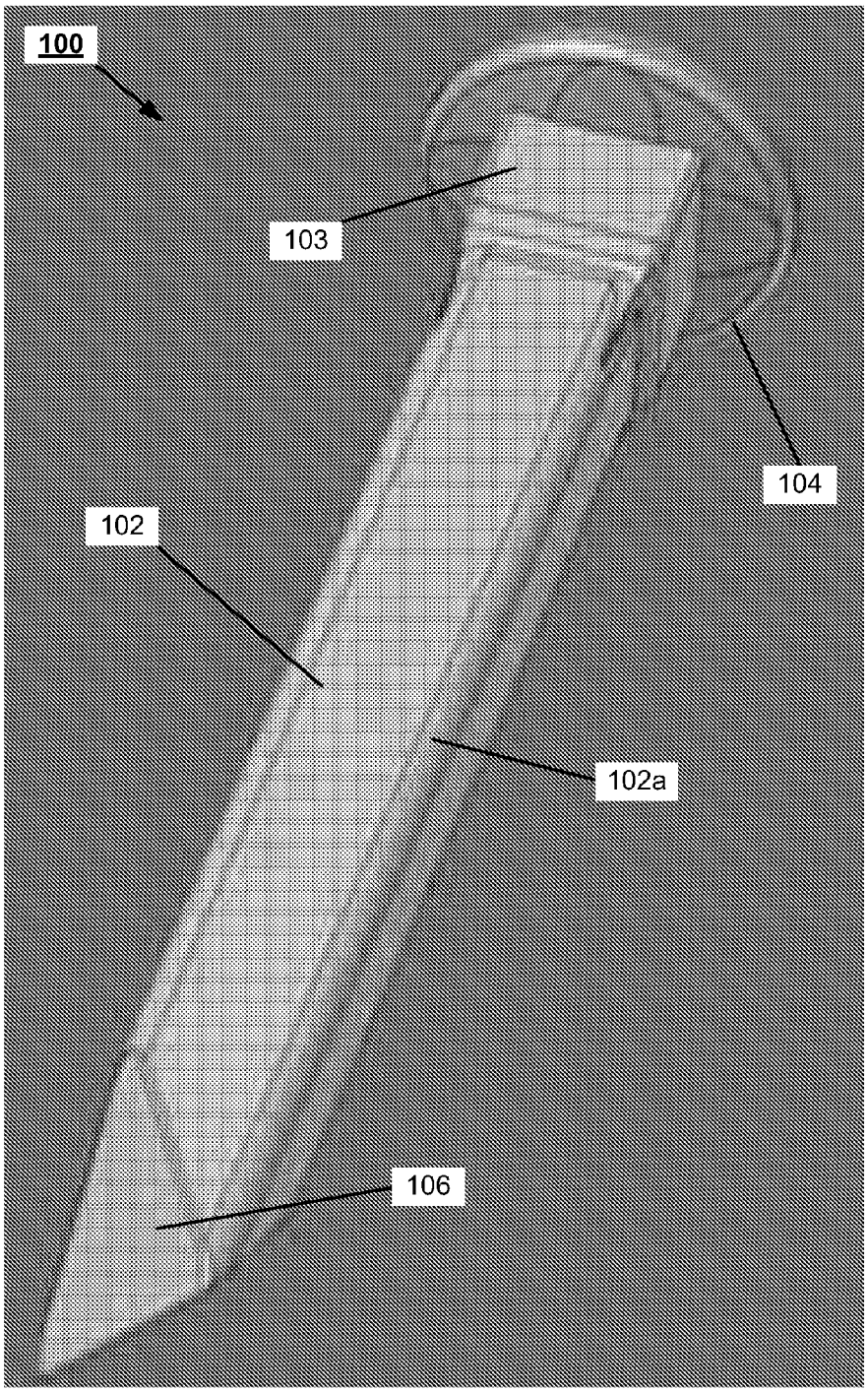
FIG. 2 shows a perspective view of an exemplary railroad spike in accordance with one embodiment of the present invention.

Referring now to FIG. 2, there is shown a perspective view of an exemplary railroad spike 100 in accordance with one embodiment of the present invention. The spike 100 is shown to have a relatively straight shank 102, a circular head 104, and a chisel-point end 106. Since the spike 100 is made from a round stock and cold worked on all sides, the overall shape is substantially symmetric. The symmetric shape allows for automatic feeding of spiker machines, which is more efficient than the current method of manual feeding.

The shank 102 may be straight or be tapered to some extent from head to point. The cross-section of the shank 102 may be substantially square. Although the edges 102*a* of the shank 102 are shown as somewhat rounded, they may also be made sharper if desired.

The circular head 104 may be formed in a separate cold heading process at a same or different time as the cold extrusion process for the shank 102. The head 104 may be shaped to engage with the dimensions of a corresponding tie plate, as describe below in connection with FIGS. 4 and 4A.

A riser 103, between the shank 102 and the head 104, may accommodate the flow of excess material during the cold heading process.

The chisel point 106 may be made at a 45° angle. By having this 45° angle, the spike 100 can be oriented in any way and the point will always be cutting the wood fibers at 45 degrees. Previous spike point is parallel to one of the sides and can only be oriented in one direction so it cuts the wood fibers. By making it 45 degrees, it also prevents splitting the wood longitudinally in the tie which is what will happen when a previous spike is inserted improperly. The sharpness of the tip may be adjusted to get the best mechanical pressure from the cut fibers. In general, the dimensions of the spike 100 can be made fully compatible with existing tie plates.

To improve its fatigue strength, the spike 100 may be cold formed from a high-strength, low-alloy (HSLA) steel, which provides better mechanical properties or greater resistance to corrosion than carbon steel, or other metal materials of desirable characteristics. For example, according to one embodiment, the HSLA steel may be chosen from one or more of the following grades: 950X, 955X, 960X, 965X, 970X, and 980X. The raw metal may be coiled or cut from a round stock. For example, a metal blank of suitable length may first be cut from a metal wire or rod with a substantially circular cross-section. Cutting the blank from a long coil of raw material has the advantage of producing less waste and can facilitate continuous feeding into the forming dies.

Prior to the subsequent cold forming process (or even prior to the cutting of blanks), the raw material may be subjected to heat treatment, such as tempering and annealing. The heat treatment may improve the raw material's ability of deformation, reduce its hardness, and/or improve metal structure towards better forming. In addition, the raw material may also be subjected to surface treatment (e.g., alkaline cleaning, acid pickling, rinsing, and drying).

Next, the metal blank may be subjected to at least one cold heading process and at least one cold extrusion process to form a railroad spike of the desired shape such as shown in FIGS. 2-6. As one of ordinary skill in the art would appreciate, there are different ways to cold form the railroad spike of a preferred shape. The metal blank is introduced through a series of cold forming dies where each die forms a different stage of the spike through a corresponding mechanical impact on the spike material. Although the dies are not illustrated here, those skilled in the art can readily determine the shapes of the dies as they correspond to the shape of the railroad spike.

By using a round part to form a square spike shank, the material is worked on all sides during the cold forming process. By not reheating the metal but processing it cold, there are multiple benefits. Reheating of steel, which costs substantial amount of time and energy, also causes additional decarburization and lowers fatigue resistance of the resulting spikes. By cold forming the spike, the ultimate strength of the steel is increased, which also improves the fatigue resistance. Furthermore, by not heating up the steel, the final spike can be shipped in plastic kegs at additional savings as compared to the use of bulky metal containers for hot-forged spikes.

After the cold forming steps, the preliminarily formed railroad spike may be subjected to additional heat treatment, surface treatment, and/or metal removal steps. For example, the spike may be annealed and/or hardened, shot peened or ground or lapped or milled, washed and/or plated.

Finally, one or more protective coating may be applied to the spike surface. In a preferred embodiment of the present invention, the railroad spike is coated with one or more protective layers of anti-corrosion chemical(s) such as disodium octaborate tetrahydrate (DOT), sodium fluoride, or the like. The coating(s) may be applied through spraying, brushing, dipping, and/or other process(es). The coating(s) can be applied to the spikes either upon their manufacturing, immediately before they are deployed, and/or anytime in between.

Figure 3:
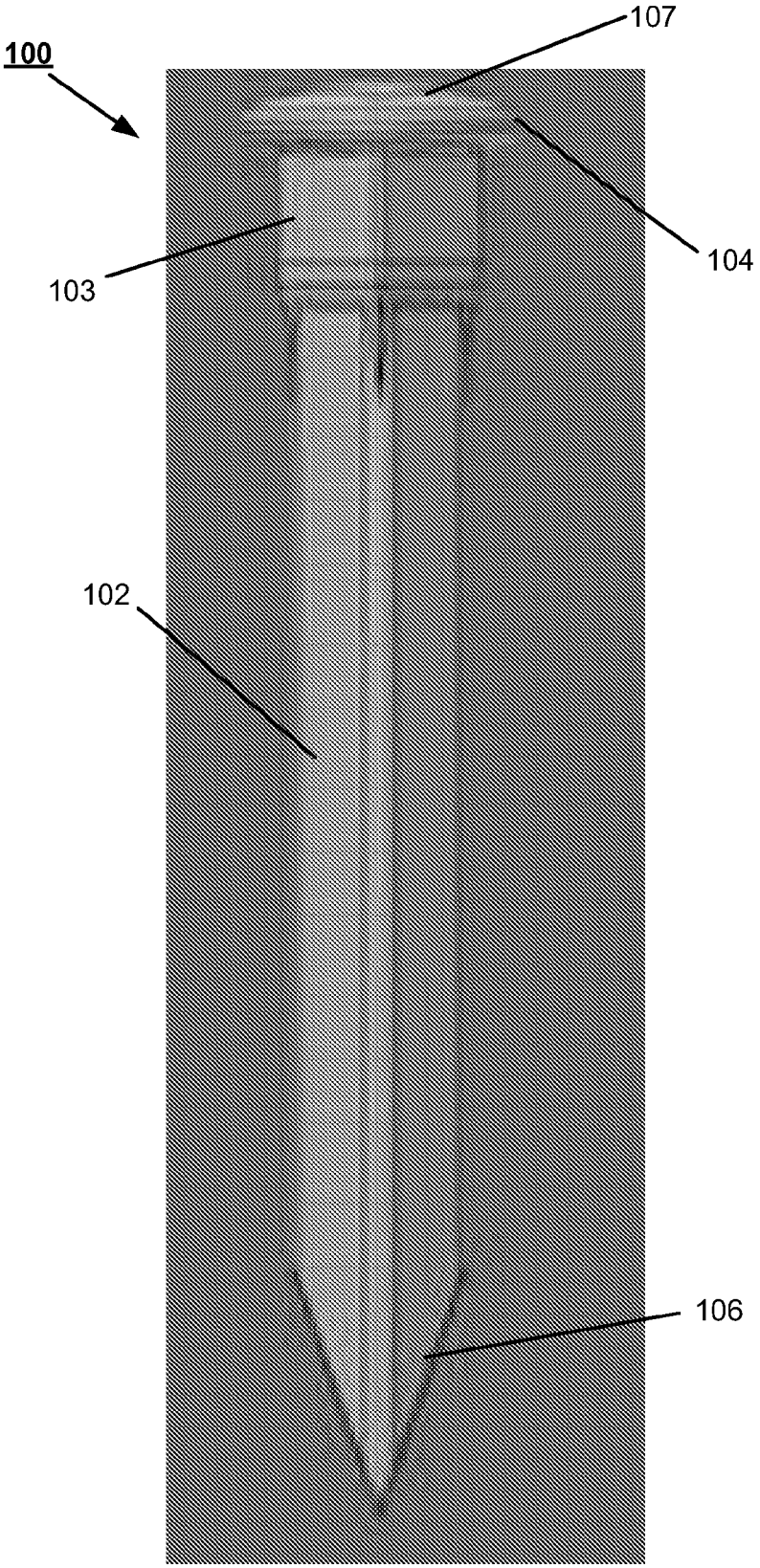
FIG. 3 shows a side view of an exemplary railroad spike in accordance with one embodiment of the present invention.

FIG. 3 shows a side view of the exemplary railroad spike 100 in accordance with one embodiment of the present invention. Note the generally symmetrical shape of the spike 100.

Figure 4:
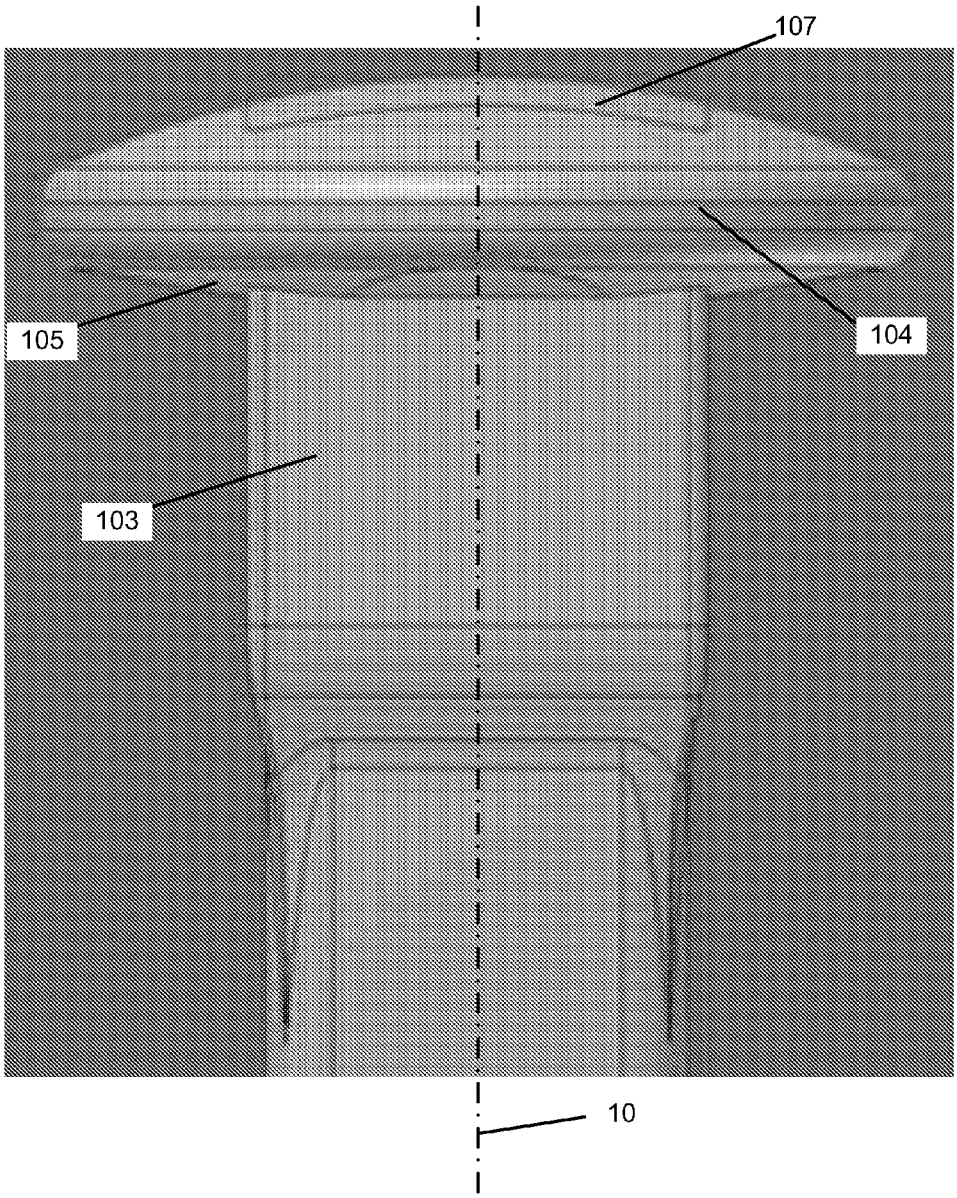
FIG. 4 shows an enlarged view of the head portion of an exemplary railroad spike in accordance with one embodiment of the present invention.

FIG. 4 shows an enlarged view of the head portion of the exemplary railroad spike 100 in accordance with one embodiment of the present invention. Note that a fillet 105 may be formed under the head 104 at a desired angle specifically to fit a tie plate or rail base.

Figure 4A:
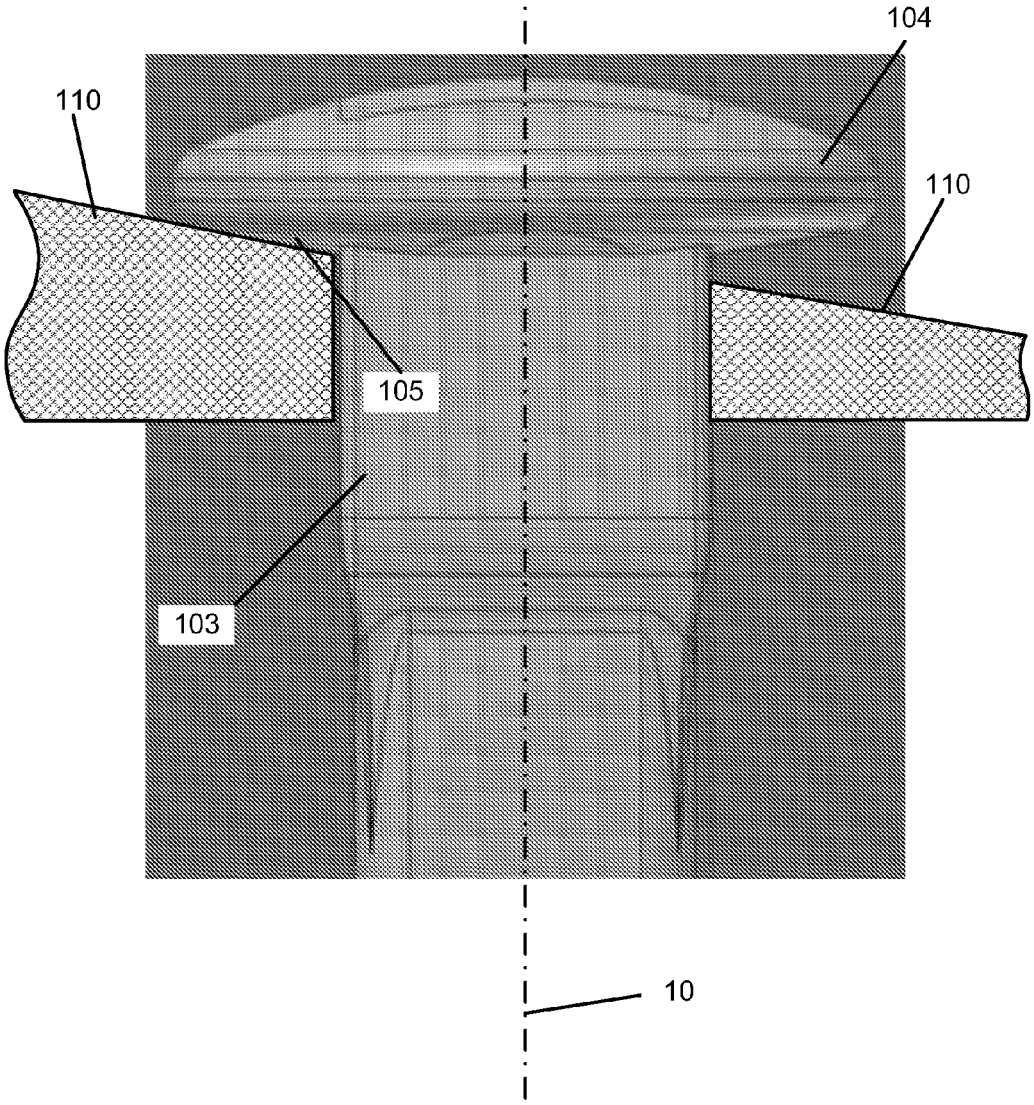
FIG. 4A shows how an exemplary railroad spike in accordance with one embodiment of the present invention engages with a tie plate or rail base.

FIG. 4A shows how the exemplary railroad spike 10 engages with a tie plate 110 (or a rail base) in accordance with one embodiment of the present invention. As shown, the tie plate 110 may have a slanted top surface that is higher on one side of the spike opening than the other side. The underside of the spike head 104 may be shaped accordingly to ensure a close engagement between the spike 100 and the tie plate 110 once the spike is fully driven in and rests against the plate. For example, the fillet 105 may be angled to match the slope of the tie plate 110. Since the spike head 104 has a circular shape, it is symmetrical all around, as is the fillet 105. Thus, the angle between the fillet 105 and a horizontal surface is the same all around. Therefore, no matter how the spike 100 is rotated around its vertical axis 10, the fillet 105 will always be able to engage the higher side of the spike opening in the tie plate 110.

Figure 5:
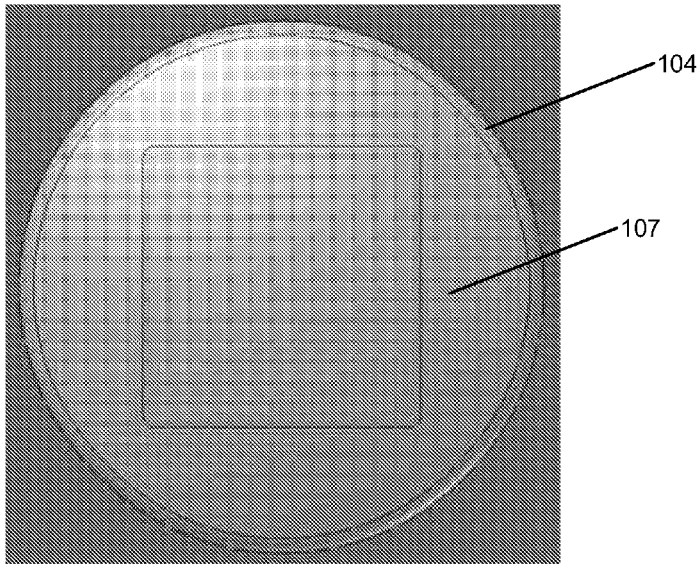
FIG. 5 shows a top view of an exemplary railroad spike in accordance with one embodiment of the present invention.
Figure 6:
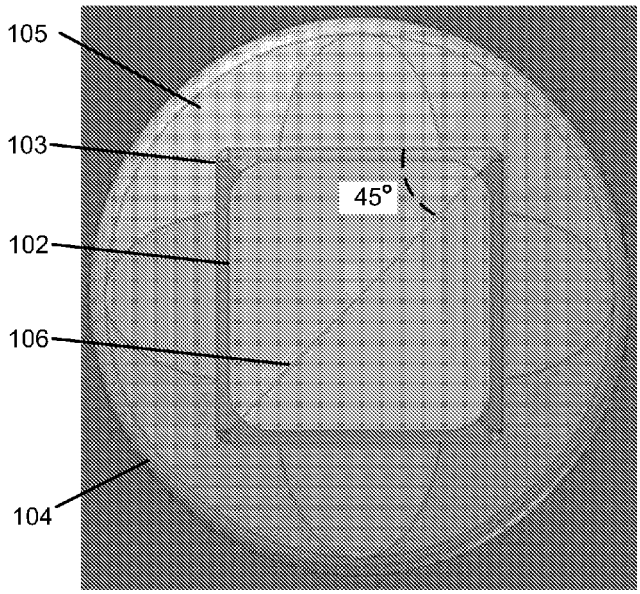
FIG. 6 shows a bottom view of an exemplary railroad spike in accordance with one embodiment of the present invention.

FIG. 5 shows a top view of the exemplary railroad spike 100 in accordance with one embodiment of the present invention. FIG. 6 shows a bottom view of the exemplary railroad spike 100 in accordance with one embodiment of the present invention.

While the foregoing description includes many details and specificities, it is to be understood that these have been included for purposes of explanation only, and are not to be interpreted as limitations of the present invention. It will be apparent to those skilled in the art that other modifications to the embodiments described above can be made without departing from the spirit and scope of the invention. Accordingly, such modifications are considered within the scope of the invention as intended to be encompassed by the following claims and their legal equivalents.

The invention claimed is:

1. A method for manufacturing a railroad spike, the method comprising:

preparing a metal blank having a substantially circular cross-section;

subjecting the metal blank to at least one cold heading process and at least one cold extrusion process to form, without any hot forging process, a railroad spike having (a) a circular head with a fillet at its bottom side that is angled to engage a railroad tie plate or rail base and (b) a non-threaded shank with a substantially smooth surface, a substantially square cross-section having a symmetric shape, and a chiseled tip with a sufficiently sharp cutting edge to cut wood fibers in a crosstie, wherein the cutting edge is substantially in parallel with a diagonal of the substantially square cross-section to avoid splitting the wood fibers in the crosstie; and coating outer surfaces of the finished railroad spike with an anti-corrosion chemical such that the coated chemical is directly exposed to the crosstie into which the railroad spike is inserted.

2. The method according to claim 1, wherein the anti-corrosion chemical comprises disodium octaborate tetrahydrate (DOT) or sodium fluoride.

3. The method according to claim 1, wherein the metal blank comprises a high-strength, low-alloy steel.

4. The method according to claim 3, wherein the high-strength, low-alloy steel is of a grade selected from a group consisting of: 950X, 955X, 960X, 965X, 970X, and 980X.

5. The method according to claim 1, further comprising: cutting the metal blank from a roll of wire stock.

6. The method according to claim 1, further comprising: cutting the metal blank from a metal rod.

7. The method according to claim 1, further comprising: subjecting the metal blank to at least one of a heat treatment and a surface treatment prior to the at least one cold heading process and the at least one cold extrusion process.

8. The method according to claim 1, further comprising: subjecting the railroad spike to at least one of a heat treatment, a surface treatment, and a metal removal process.

9. The method according to claim 1, further comprising: annealing the metal blank and/or the railroad spike.

10. The method according to claim 1, further comprising: hardening the railroad spike.

* * * * *